US006185981B1

(12) United States Patent
Chen

(10) Patent No.: US 6,185,981 B1
(45) Date of Patent: Feb. 13, 2001

(54) TRANSMISSION CONTROL SYSTEM FOR A WIRE FORMING MACHINE

(76) Inventor: Wen-Der Chen, No. 19-2, Lane 326, Lien-Tsun Rd., Fengyuan City, Taichung Hsien (TW)

( * ) Notice: Under 35 U.S.C. 154(b), the term of this patent shall be extended for 0 days.

(21) Appl. No.: 09/376,629

(22) Filed: Aug. 18, 1999

(51) Int. Cl.[7] ..... B21J 13/10
(52) U.S. Cl. ..... 72/420; 72/135; 72/142
(58) Field of Search ..... 72/135, 137, 142, 72/144, 145, 146, 420, 441, 446, 447

(56) References Cited

U.S. PATENT DOCUMENTS

| | | | | |
|---|---|---|---|---|
| 4,084,420 | * | 4/1978 | Tsutsumino | 72/138 |
| 5,105,641 | * | 4/1992 | Veit | 72/137 |
| 5,363,681 | * | 11/1994 | Speck et al. | 72/137 |
| 5,442,944 | * | 8/1995 | Lu | 72/137 |
| 6,006,572 | * | 12/1999 | Tsuritani | 72/135 |

* cited by examiner

*Primary Examiner*—Ed Tolan

(74) *Attorney, Agent, or Firm*—Dorsey & Whitney LLP

(57) ABSTRACT

A transmission control system for a wire forming machine includes a slide base and a transmission control device attached thereto. A feed unit is slidably mounted on the slide base and has a screw base mounted thereon. The slide base has a through hole therein and a slot to allow the screw base to move therein and a groove to receive a rail therein. The transmission control device includes a bearing seat received in the through hole of the slide base and a bearing received in the bearing seat. The transmission control device further includes a moving control unit and a power source, the moving control unit connected to the screw base and the power source supplying the power to the moving unit to control the position of the feed unit. The feed unit further includes a horizontal base plate and a vertical support plate. The base plate has a plurality of slides each attached thereto and having a groove to receive the rail and slidably mounted on the slide base. The support plate extends from the base plate. The feed unit has a quill seat attached to the support plate of the feed unit and has a quill attached to the quill seat. The screw base is L-shaped having a bracket attached to the base plate of the feed unit, and having a vertical side extending from the bracket. The screw base also has a nut which is mounted on the vertical side of the bracket.

9 Claims, 6 Drawing Sheets

TRANSMISSION CONTROL SYSTEM FOR A WIRE FORMING MACHINE

CROSS-REFERENCES TO RELATED APPLICATIONS

Not Applicable.

BACKGROUND OF THE INVENTION

1. Field of the Invention

The present invention relates to a transmission control system, and more particularly, to a transmission control system for a wire forming machine that includes a slide base having a transmission control device attached thereto. A feed unit is slidably mounted on the slide base and has a screw base mounted thereon.

2. Description of the Related Art

Referring to FIGS. 4–6, a conventional wire forming machine comprises a support plate (70), a tool slide support (80), a feed unit (71) and a straightening unit (73). A quill (74) is attached to the support plate (70) and multiple tool slide supports (80) are inwardly and radially attached to the support plate (70). Each tool slide supports (80) has a motor (81) to supply power to the tool slide support (80) to slide the tool slide support (80) radially on the support plate (70).

The tool slide support (80) has a support seat (85) that is attached to the support plate (70). A tool slide (851) is slidably mounted on the support seat (85). A tool holder (82) and a motor (81) are attached to the tool slide (851). A positioning bar (821) has a first end received in the tool slide (851) and a second end screwed on the tool holder (82). A locking nut (83) is screwed on the positioning bar (821) to limit the tool holder (82) from rotation. A forming tool (84) is attached to the tool holder (82). When the wire forming machine is operating, the wire (50) is pulled by a feed unit (71) having multiple feed rollers (72) through a straightening unit (73) having multiple rollers (731). The forming tool (84) slides downward to abut the wire (50) and continues to move along the support seat (85) so as to form the wire (50) when the wire (50) moves over the quill (74). The characteristics of the wire (50) are determined by the distance between the forming tool (84) and the quill (74). To adjust the distance, a worker must loosen the locking nuts (83) and move the tool holder (82) on the positioning bar (821) toward or away from the tool slide (851).

The locking nuts (83) often need to be loosened to move the tool holder (82) and tightened to adjust the position of the forming tool (84) because the wire forming machine usually has multiple tool slide supports (80). Much time is wasted in adjusting the distance from the quill (74) to the forming tool (84).

The present invention has arisen to mitigate and/or obviate the disadvantage of the conventional wire forming machine.

BRIEF SUMMARY OF THE INVENTION

In accordance with one aspect of the present invention, a transmission control system for a wire forming machine includes a slide base and a transmission control device attached to it. A feed unit is slidably mounted on the slide base and has a screw base attached. The transmission control system is a device for adjusting working parameters of a wire forming machine. A quill is mounted on the feed unit and is separate from the forming tools. The feed unit and the quill slide linearly on the slide base by the transmission control system.

Further benefits and advantages of the present invention will become apparent after a careful reading of the detailed description with appropriate reference to the accompanying drawings.

DETAILED DESCRIPTION OF THE INVENTION

Figure 1:
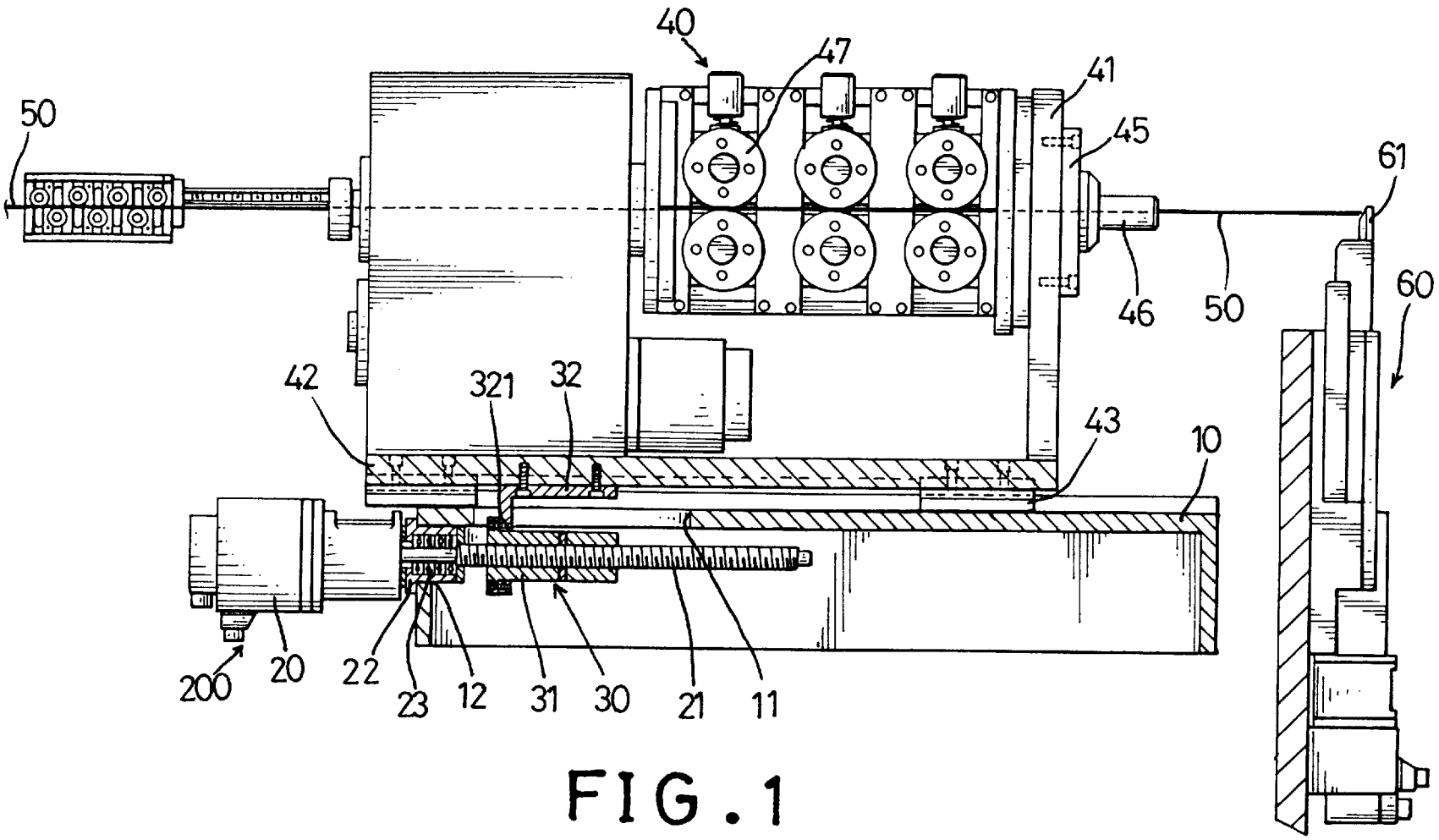
FIG. 1 is a side plan view in partial section of a transmission control system in accordance with the present invention on a wire forming machine with the feed unit back.
Figure 2:
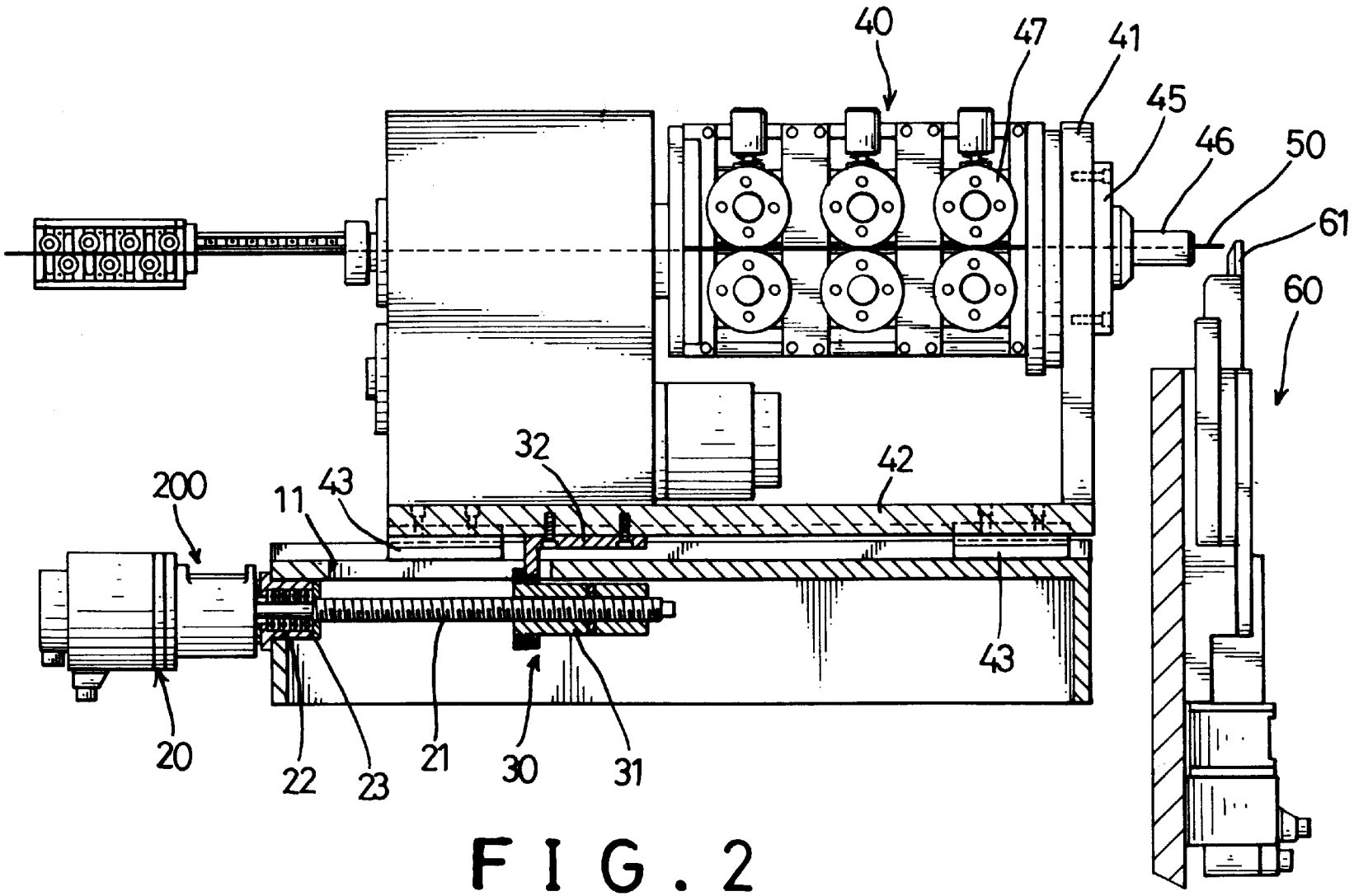
FIG. 2 is a side plan view in partial section of the transmission control system and wire forming machine as shown in FIG. 1 with the feed unit is forward.
Figure 3:
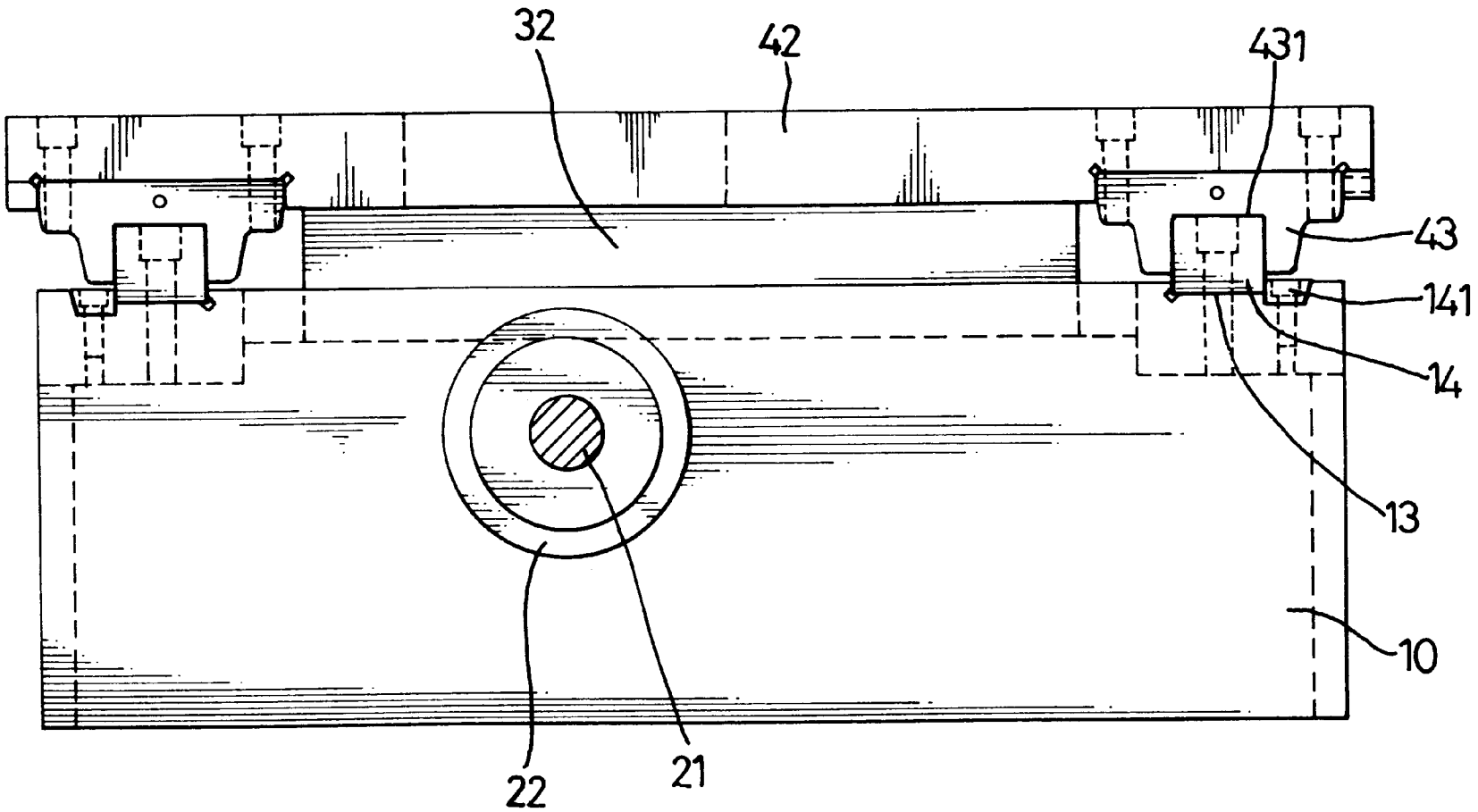
FIG. 3 is a rear plan view in partial section of the transmission control system as shown in FIG. 1.
Figure 4:
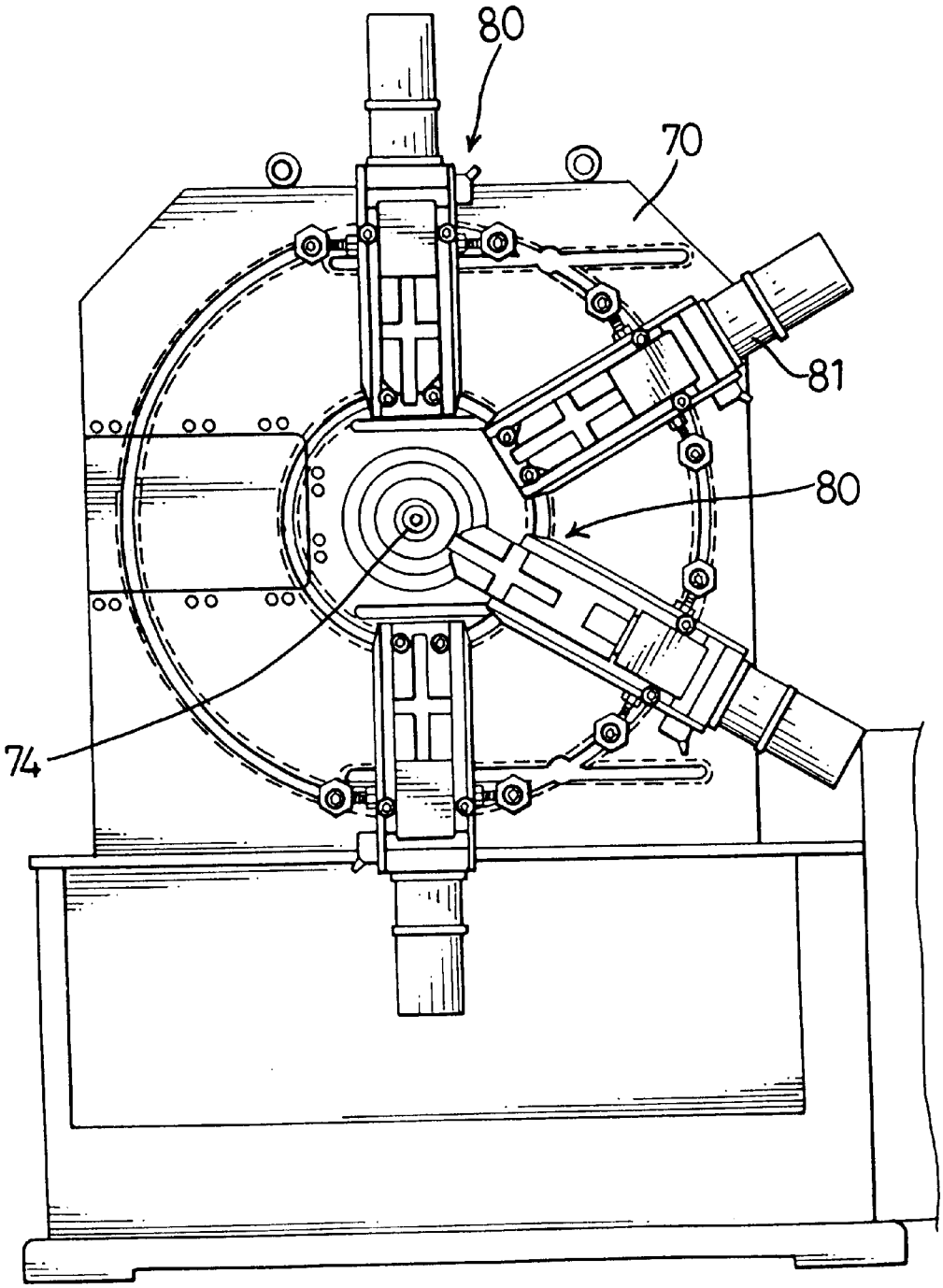
FIG. 4 PRIOR ART
FIG. 4 is a front plan view of a conventional wire forming machine in accordance with the prior art.
Figure 5:
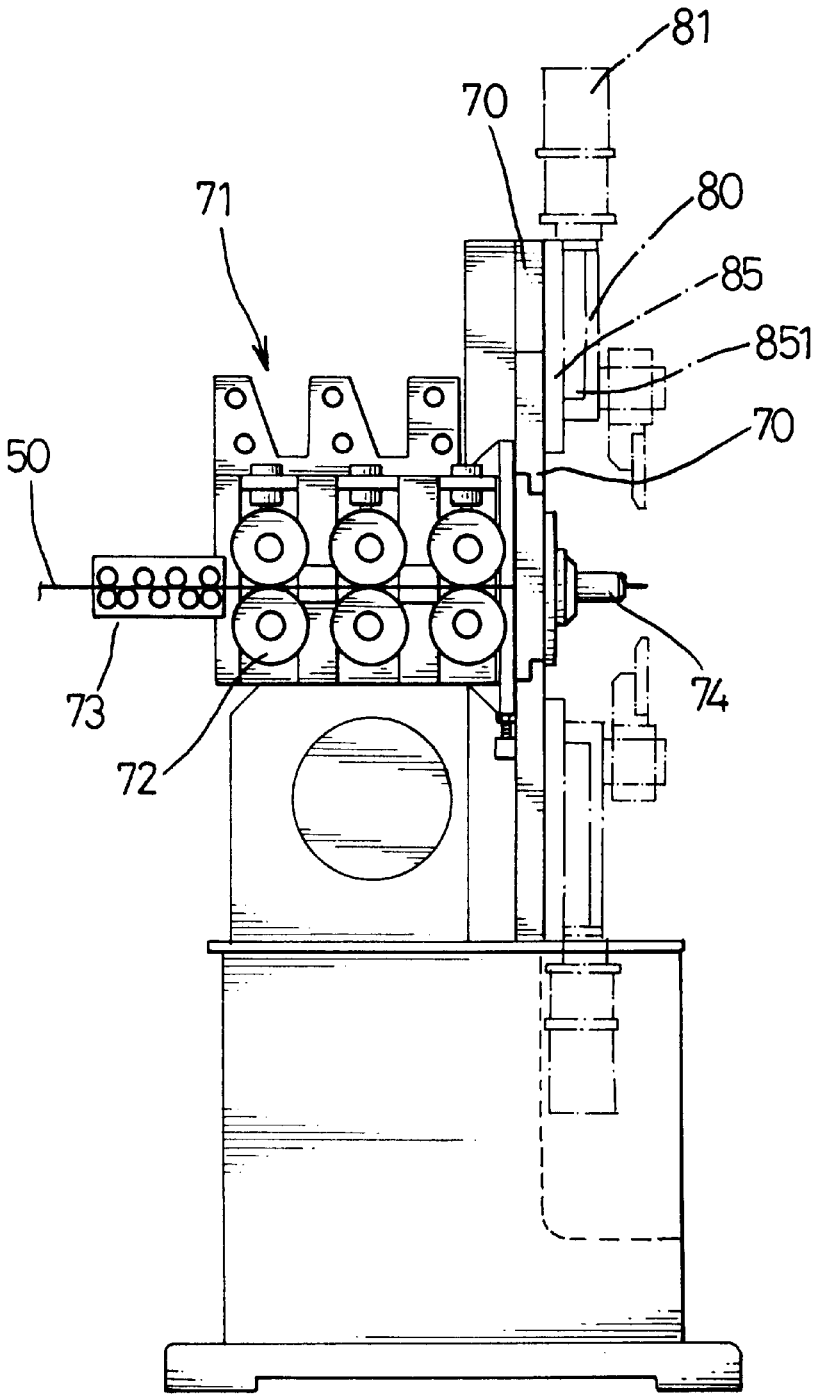
FIG. 5 PRIOR ART
FIG. 5 is a left side plan view of a conventional wire forming machine in accordance with the prior art.
Figure 6:
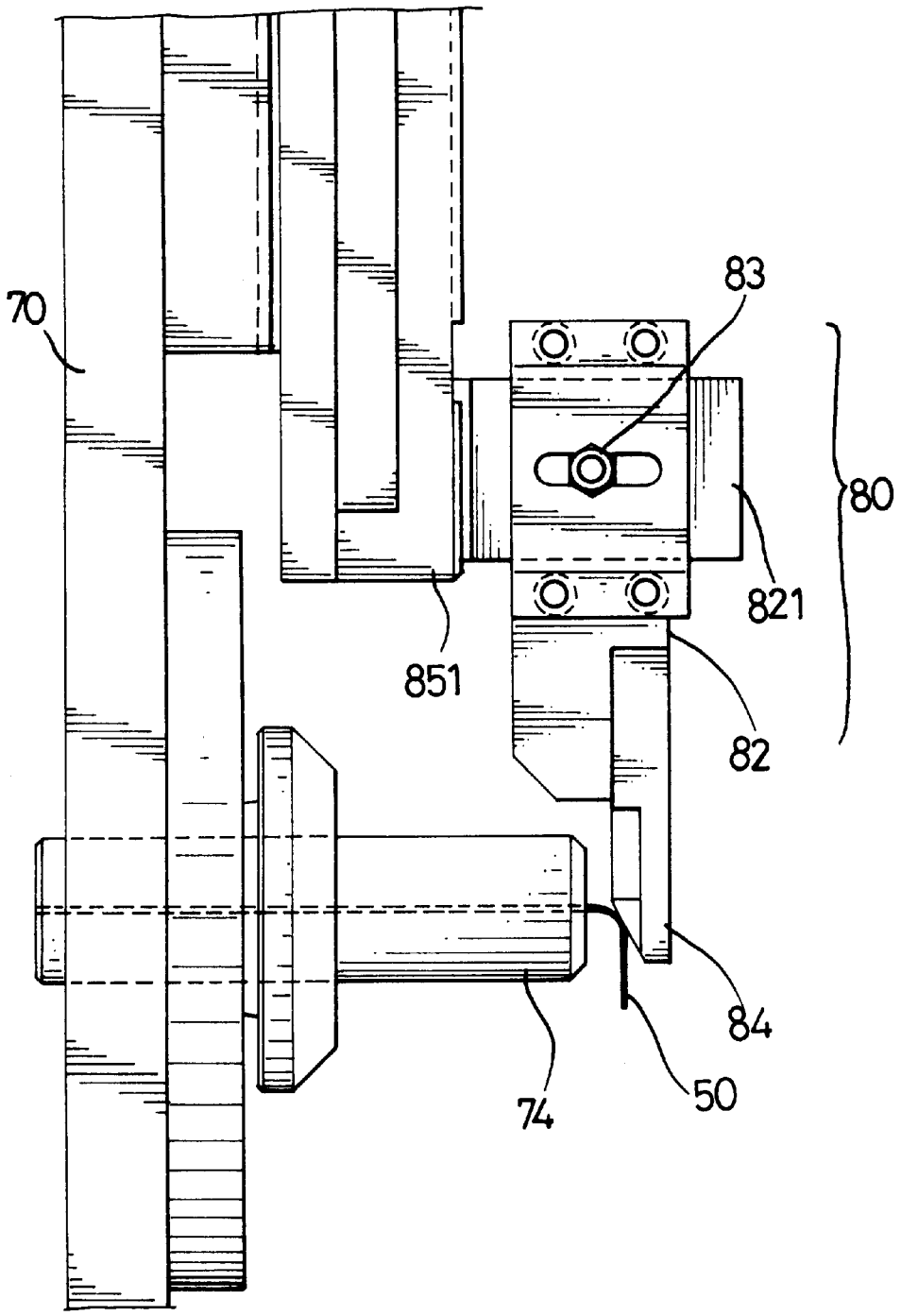
FIG. 6 PRIOR ART
FIG. 6 is a side plan view of the quill and tool assembly in a conventional wire forming machine as shown in FIG. 4.

Referring to the drawings and initially to FIGS. 1–3, a transmission control system for a wire forming machine in accordance with the present invention comprises a slide base (10) and a transmission control device (200) attached thereto. A feed unit (40) is slidably mounted on the slide base (10) and has a screw base (30) mounted thereon. The top of the slide base (10) contains a slot (11) to allow the screw base (30) to move therein and a groove (13) to receive a rail (14). The side of the slide base (10) contains a through hole (12) therein. The slide base (10) further comprises a fixing member (141) attached thereto and abutting the rail (14).

The transmission control device (200) includes a bearing seat (22) securely received in the through hole (12) of the slide base (10) and a bearing (23) securely received in the bearing seat (22). The transmission control device (200) includes a moving control unit (21) and a power source (20), the moving control unit (21) connected to the screw base (30) and the power source (20) supplying the power to the moving unit (21) to control the position of the feed unit (40).

The feed unit (40) has at least one pair of feed rollers (47) therein, the pair of feed rollers (47) abutting each other. The feed unit (40) further includes a horizontal base plate (42) and a vertical support plate (41). The base plate (42) has a plurality of slides (43) each attached thereto and having a groove (431) to receive the rail (14) and slidably mounted on the slide base (10). The support plate (41) extends from the base plate (42). Furthermore the feed unit has a quill seat (45) attached to the support plate (41) of the feed unit (40) and has a quill (46) attached to the quill seat (45).

The screw base (30) is L-shaped having a bracket (32) attached to the base plate (42) of the feed unit (40) with a vertical side (321) extending from the bracket (32). The screw base (30) also has a nut (31) mounted on the vertical side (321) of the bracket (32).

Referring to FIGS. 1–2, when adjusting the working parameters of the wire (50), the transmission control system does not need to adjust the tool support (60) and the forming tool (61). The power source (20) of the transmission control device (200) rotates the moving unit (21) to drive the nut (31) along the moving unit (21) in the slot (11) of the slide base (10). So that the bracket (32) transmits the moving force to the feed unit (40) and the quill (46) to move the slides (43) on the rail (13) of the slide base (10). Then the distance between the quill (46) and the forming tool (61) is changed to effectively move the forming tool (61) toward or away from the wire (50) in operation.

Although the invention has been explained in relation to its preferred embodiment, it is to be understood that many other possible modification and variation can be made without departing from the spirit and scope of the invention as hereinafter claimed.

What is claimed is:

1. A transmission control system for a wire forming machine comprising:

a slide base (10);

a transmission control device (200) attached to said slide base (10);

a feed unit (40) slidably mounted on said slide base (10) and having at least one pair of feed rollers (47), said pair of feed roller (47) abutting each other, said feed unit (40) including a horizontal base plate (42) slidably mounted on said slide base (10) and a vertical support plate (41) vertically extending from one end of said base plate (42);

a quill seat (45) attached to said support plate (41) of said feed unit (40);

a quill (46) attached to said quill seat (45); and a screw base (30) attached to the bottom of said feed unit (40).

2. The transmission control system for a wire forming machine in accordance with claim 1, wherein the top of said slide base (10) contains a slot (11) to allow said screw base (30) to move therein and a groove (13) to receive a rail (14) thereon and a side containing a through hole (12) therein.

3. The transmission control system for a wire forming machine in accordance with claim 2, wherein said slide base (10) further comprises a fixing member (141) attached thereto and abutting said rail (14).

4. The transmission control system for a wire forming machine in accordance with claim 2, wherein said transmission control device (200) includes a bearing seat (22) securely received in said through hole (12) of said slide base (10).

5. The transmission control system for a wire forming machine in accordance with claim 4, wherein said transmission control device (200) includes a bearing (23) securely received in said bearing seat (22).

6. The transmission control system for a wire forming machine in accordance with claim 1, wherein said transmission control device (200) includes a moving control unit (21) and a power source (20), said moving control unit (21) connected to said screw base (30) and said power source (20) supplying the power to said moving unit (21) to control the position of said feed unit (40).

7. The transmission control system for a wire forming machine in accordance with claim 2 wherein said feed unit (40) includes a plurality of slides (43) each attached to said base plate (42), said slides (43) having a groove (431) to receive said rail (14) and slidably mounted on said slide base (10).

8. The transmission control system for a wire forming machine in accordance with claim 7, wherein said screw base (30) is L-shaped having a bracket (32) attached to said base plate (42) of said feed unit (40), and having a vertical side (321) extending from said bracket (32).

9. The transmission control system for a wire forming machine in accordance with claim 8, wherein said screw base (30) includes a nut (31) mounted on said vertical side (321) of said bracket (32).

* * * * *